US010753688B2

(12) United States Patent
Higashiiue et al.

(10) Patent No.: US 10,753,688 B2
(45) Date of Patent: Aug. 25, 2020

(54) DISTRIBUTER, HEAT EXCHANGER, AND AIR-CONDITIONING APPARATUS

(71) Applicant: Mitsubishi Electric Corporation, Tokyo (JP)

(72) Inventors: Shinya Higashiiue, Tokyo (JP); Ryota Akaiwa, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 95 days.

(21) Appl. No.: 16/072,525

(22) PCT Filed: Apr. 7, 2016

(86) PCT No.: PCT/JP2016/061361
§ 371 (c)(1),
(2) Date: Jul. 25, 2018

(87) PCT Pub. No.: WO2017/175346
PCT Pub. Date: Oct. 12, 2017

(65) Prior Publication Data

US 2019/0033018 A1 Jan. 31, 2019

(51) Int. Cl.
*F28F 9/02* (2006.01)
*F25B 39/02* (2006.01)
(Continued)

(52) U.S. Cl.
CPC ..... *F28F 9/0278* (2013.01); *F25B 39/022* (2013.01); *F25B 39/028* (2013.01);
(Continued)

(58) Field of Classification Search
CPC ..... F28F 9/0278; F28F 9/0221; F28F 9/22; F25B 39/022; F25B 39/028; F28D 1/05325; F28D 1/05391
See application file for complete search history.

(56) References Cited

U.S. PATENT DOCUMENTS 1,484,749 A * 2/1924 Yeager ..... F28F 9/0278 165/174
4,023,618 A * 5/1977 Kun ..... F28D 9/00 165/175
(Continued)

FOREIGN PATENT DOCUMENTS

JP H06-011291 A 1/1994
JP H09-189463 A 7/1997
(Continued)

OTHER PUBLICATIONS

International Search Report ("ISR") dated Jun. 21, 2016 issued in corresponding International patent application No. PCT/JP2016/061361 (with English translation).
(Continued)

*Primary Examiner* — Jon T. Schermerhorn, Jr.
(74) *Attorney, Agent, or Firm* — Posz Law Group, PLC

(57) ABSTRACT

A distributer includes a housing having a surface portion and through holes extending through the surface portion, a plurality of plates stacked with each other in the housing, the plurality of plates including a first plate that is an outermost one of the plurality of plates and has a first opening extending through the first plate, and a second plate that is the other outermost one of the plurality of plates and has a plurality of second openings extending through the second plate, a branching flow path connecting the first opening and the plurality of second openings, a plurality of connection pipes each extending through a corresponding one of the through holes in the surface portion of the housing, and a partition plate disposed between the surface portion and the second plate, and abutting on both the surface portion and the second plate.

16 Claims, 7 Drawing Sheets

(51) Int. Cl.

| | |
|---|---|
| ***F28D 1/053*** | (2006.01) |
| ***F28F 9/22*** | (2006.01) |
| ***F28D 21/00*** | (2006.01) |
| ***F25B 13/00*** | (2006.01) |
| ***F25B 39/04*** | (2006.01) |
| ***F25B 41/04*** | (2006.01) |

(52) U.S. Cl.
CPC ..... *F28D 1/05325* (2013.01); *F28D 1/05391* (2013.01); *F28F 9/0221* (2013.01); *F28F 9/22* (2013.01); *F25B 13/00* (2013.01); *F25B 39/04* (2013.01); *F25B 41/043* (2013.01); *F28D 2021/0068* (2013.01)

(56) References Cited

U.S. PATENT DOCUMENTS

| | | | | |
|---|---|---|---|---|
| 5,241,839 | A * | 9/1993 | Hughes | B60H 1/3227 165/174 |
| 5,242,016 | A | 9/1993 | Voss et al. | |
| 7,637,314 | B2 * | 12/2009 | Park | F28F 9/0221 165/174 |
| 2005/0284621 | A1 * | 12/2005 | Katoh | F28F 9/0278 165/174 |
| 2008/0202153 | A1 * | 8/2008 | Watanabe | F28F 9/0278 62/498 |
| 2008/0314076 | A1 * | 12/2008 | Ichiyanagi | F28F 9/0246 62/513 |
| 2010/0020635 | A1 | 1/2010 | Huhta | |
| 2010/0206535 | A1 * | 8/2010 | Munoz | F28F 9/0273 165/173 |
| 2015/0027672 | A1 | 1/2015 | Jindou et al. | |
| 2016/0169595 | A1 | 6/2016 | Matsuda et al. | |
| 2016/0223265 | A1 | 8/2016 | Jindou et al. | |
| 2016/0245596 | A1 | 8/2016 | Higashiiue et al. | |

FOREIGN PATENT DOCUMENTS

| | | | |
|---|---|---|---|
| JP | 2004-293811 | A | 10/2004 |
| JP | 2007-127347 | A | 5/2007 |
| JP | 2015-078833 | A | 4/2015 |
| WO | 2013/150795 | A1 | 10/2013 |
| WO | 2014/185391 | A1 | 11/2014 |
| WO | 2015/063857 | A1 | 5/2015 |

OTHER PUBLICATIONS

Office Action dated Jun. 25, 2019 issued in corresponding JP patent application No. 2018-510183 (and English translation).

* cited by examiner

DISTRIBUTER, HEAT EXCHANGER, AND AIR-CONDITIONING APPARATUS

CROSS REFERENCE TO RELATED APPLICATION

This application is a U.S. national stage application of PCT/JP2016/061361 filed on Apr. 7, 2016, the contents of which are incorporated herein by reference.

TECHNICAL FIELD

The present invention relates to a distributer used in a thermal circuit or other devices, a heat exchanger, and an air-conditioning apparatus.

BACKGROUND ART

A known distributer (a stacked header) is configured to distribute and supply fluid to each of the heat transfer tubes of a heat exchanger. Such a distributer is configured to distribute and supply the fluid to each of the heat transfer tubes of the heat exchanger, by arranging and brazing a plurality of stacked plates to form a branching flow path branching from one incoming flow path into a plurality of outgoing flow paths (see Patent Literature 1, for example).

CITATION LIST

Patent Literature

Patent Literature 1: Japanese Unexamined Patent Application Publication No. 9-189463

SUMMARY OF INVENTION

Technical Problem

In such a distributer (the stacked header), the plates are configured by using aluminum, and the aluminum plates are fixed to each other through the brazing process. This configuration, however, may have a problem where, because the plates are exposed to the outside, the plates are corroded by moisture from condensation or other factors, which may lead to leakage of refrigerant. Further, because the branching flow path is directly connected to the heat transfer tubes, a problem may arise in which, when a drift of the refrigerant occurs in the branching flow path, the refrigerant is unevenly supplied to the heat transfer tubes, which may degrade the heat transfer performance of the heat exchanger.

In view of the problems described above, it is an object of the present invention to obtain a distributer (a stacked header) capable of ensuring the heat exchanging performance of the heat exchanger by causing refrigerant to be distributed evenly to the heat transfer tubes of the heat exchanger and capable of preventing leakage of the refrigerant.

Solution to Problem

A distributer according to an embodiment of the present invention includes a housing having a surface portion and through holes extending through the surface portion, a plurality of plates stacked with each other in the housing, the plurality of plates including a first plate that is an outermost one of the plurality of plates and has a first opening extending through the first plate, and a second plate that is the other outermost one of the plurality of plates and has a plurality of second openings extending through the second plate, a branching flow path connecting the first opening and the plurality of second openings, a plurality of connection pipes each extending through a corresponding one of the through holes in the surface portion of the housing, and a partition plate disposed between the surface portion and the second plate, and abutting on both the surface portion and the second plate.

Advantageous Effects of Invention

In the distributer according to an embodiment of the present invention, the gap spaces are defined between the surface portion and the second plate in the housing by the partition plate. The stored refrigerant is homogenized in the gap spaces and then flows into the connection pipes (the heat transfer tubes) evenly. Consequently, it is possible to prevent liquid refrigerant and gas refrigerant in the form of drifts from flowing into the connection pipes (the heat transfer tubes). It is therefore possible to bring out a maximum level of heat transfer performance of the heat exchanger.

Further, because the plurality of plates are housed in the housing, it is possible to prevent the plates from being corroded. It is therefore possible to prevent leakage of the refrigerant from the branching flow path.

DESCRIPTION OF EMBODIMENTS

Figure 1:
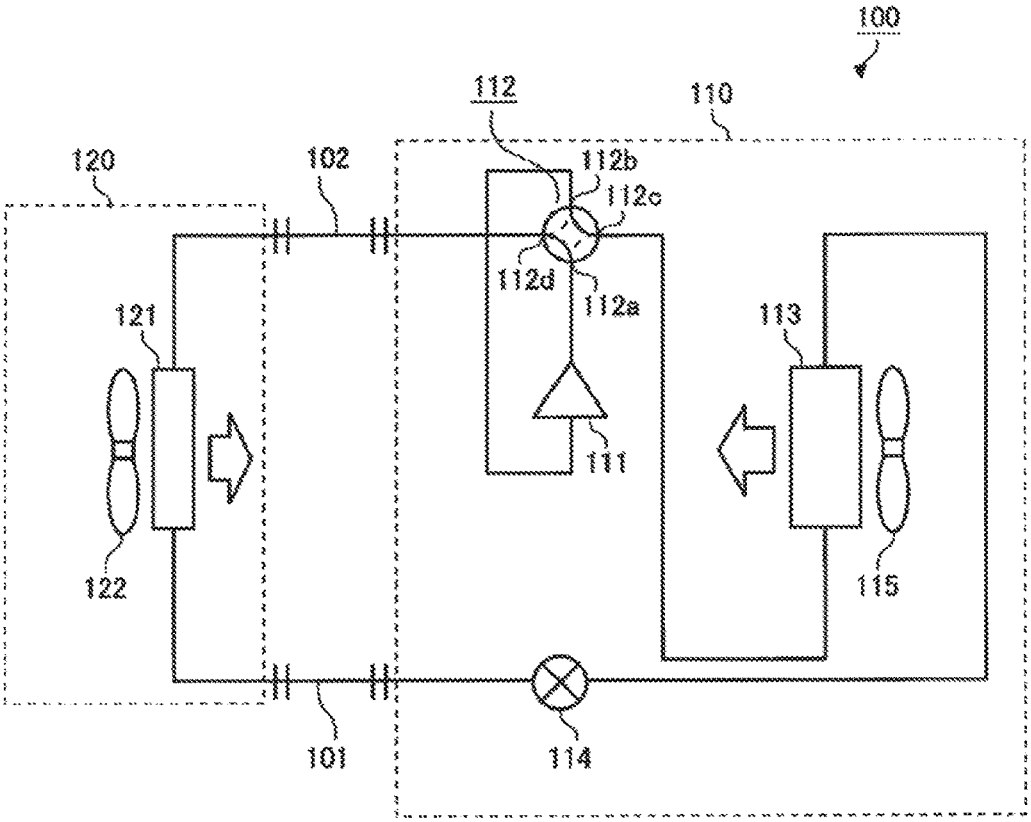
FIG. 1 is a configuration diagram of a refrigeration cycle apparatus 100 according to Embodiment 1.

A distributer (a stacked header), a heat exchanger, and an air-conditioning apparatus according to the present invention will be explained below, with reference to the drawings.

The configurations, operations, and other features explained below are merely examples. The distributer, the heat exchanger, and the air-conditioning apparatus according to the present invention are not limited to the configurations, operations, and features explained below. Further, in the drawings, some of the elements that are the same as or similar to one another are referred to by using the same reference signs, or the use of reference signs for such elements is omitted. Further, the illustration of detailed structures in the drawings is either simplified or omitted, as appropriate. Further, duplicate or similar explanations will be either simplified or omitted, as appropriate.

In the following sections, examples will be explained in which the distributer and the heat exchanger according to the present invention are applied to an air-conditioning apparatus; however, the distributer and the heat exchanger are not limited to those in the examples. For example, the distributer and the heat exchanger according to the present invention may be applied to other refrigeration cycle apparatuses each including a refrigerant cycle circuit. Further, although the heat medium to be used is described as refrigerant of which the phase changes, it is also acceptable to use a fluid of which the phase does not change.

Embodiment 1

A distributer, a heat exchanger, and a refrigeration cycle apparatus according to Embodiment 1 will be explained.

<A Configuration of a Refrigeration Cycle Apparatus 100>

FIG. 1 is a configuration diagram of a refrigeration cycle apparatus 100 according to Embodiment 1.

The refrigeration cycle apparatus 100 includes an outdoor unit 110 and an indoor unit 120. The outdoor unit 110 and the indoor unit 120 are connected to each other via a liquid-side communication pipe 101 and a gas-side communication pipe 102. In the refrigeration cycle apparatus 100, a refrigerant circuit is formed by the outdoor unit 110, the indoor unit 120, the liquid-side communication pipe 101 and the gas-side communication pipe 102.

The refrigerant circuit is provided with a compressor 111, a four-way switching valve 112, an outdoor heat exchanger 113, an expansion valve 114, and an indoor heat exchanger 121. The compressor 111, the four-way switching valve 112, the outdoor heat exchanger 113, and the expansion valve 114 are housed in the outdoor unit 110. An outdoor fan 115 used for supplying outdoor air to the outdoor heat exchanger 113 is provided to the outdoor unit 110. In contrast, the indoor heat exchanger 121 is housed in the indoor unit 120. An indoor fan 122 used for supplying indoor air to the indoor heat exchanger 121 is provided to the indoor unit 120.

In the refrigerant circuit configured as described above, a discharge pipe of the compressor 111 is connected to a first port 112*a* of the four-way switching valve 112. Further, a suction pipe pf the compressor 111 is connected to a second port 112*b* of the four-way switching valve 112. Furthermore, in the refrigerant circuit, between a third port 112*c* and a fourth port 112*d* of the four-way switching valve 112, the outdoor heat exchanger 113, the expansion valve 114, and the indoor heat exchanger 121 are sequentially connected by refrigerant pipes.

<An Operation of the Refrigeration Cycle Apparatus 100>

Next, an operation of the refrigeration cycle apparatus 100 will be explained. The refrigeration cycle apparatus 100 is capable of performing a cooling operation and a heating operation by switching the flow paths of the four-way switching valve 112.

In the refrigerant circuit during a heating operation, a refrigeration cycle is formed while the four-way switching valve 112 is switched into the state of having a flow path as indicated with the solid line in FIG. 1. During the heating operation, the refrigerant caused to have high temperature and high pressure and output from the compressor 111 flows through the four-way switching valve 112 and the indoor heat exchanger 121 in the stated order and further heats and condenses the air output from the indoor fan 122 at the indoor heat exchanger 121. Subsequently, the refrigerant is decompressed by the expansion valve 114 and flows into the outdoor heat exchanger 113. The refrigerant passing through the inside of the outdoor heat exchanger 113 is heated and evaporated by the air output from the outdoor fan 115. Subsequently, the refrigerant passes through the four-way switching valve 112 and flows into a suction port of the compressor 111.

In contrast, a cooling operation is performed by switching the four-way switching valve 112 to have a flow path as indicated with the broken line in FIG. 1. In this situation, the refrigerant flows in the direction reversed from the direction during the heating operation, so that the outdoor heat exchanger 113 acts as a condenser, while the indoor heat exchanger 121 acts as an evaporator.

<A Configuration of a Heat Exchanger 50>

Figure 2:
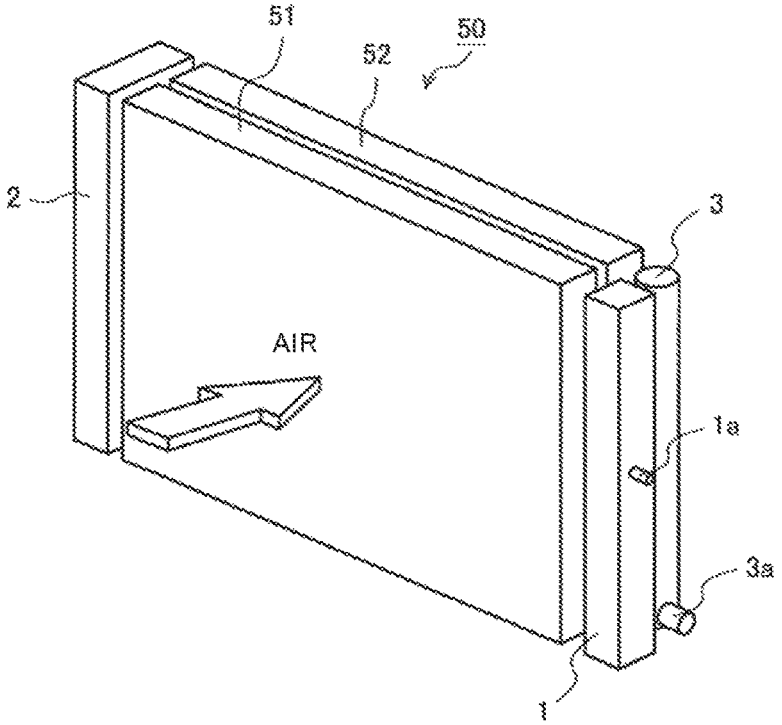
FIG. 2 is a perspective view of a heat exchanger 50 according to Embodiment 1.

FIG. 2 is a perspective view of a heat exchanger 50 according to Embodiment 1.

Figure 3:
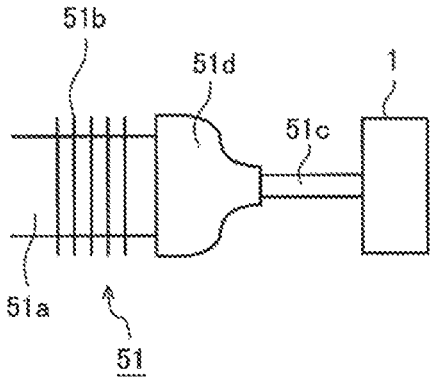
FIG. 3 is a plan view showing the surroundings of a distributer 1 according to Embodiment 1.

FIG. 3 is a plan view showing the surroundings of the distributer 1 according to Embodiment 1.

Figure 4:
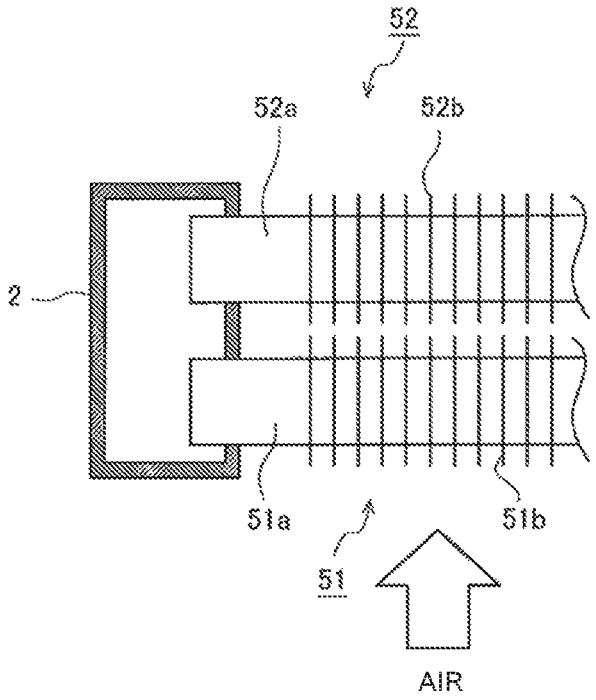
FIG. 4 is a plan view showing the surroundings of a communication header 2 according to Embodiment 1.

FIG. 4 is a plan view showing the surroundings of a communication header 2 according to Embodiment 1.

As illustrated in FIG. 2, the heat exchanger 50 is structured with a first heat transfer unit 51 provided on the upstream of the air passing through, and a second heat transfer unit 52 provided on the downstream of the air passing through. The distributer 1 is disposed on one end of the first heat transfer unit 51, whereas the communication header 2 is disposed on the other end of the first heat transfer unit 51.

Further, a gas header 3 is disposed on one end of the second heat transfer unit 52, whereas the communication header 2 is disposed on the other end of the second heat transfer unit 52. The distributer 1 has a connection pipe 1*a* to which a refrigerant pipe of the refrigeration cycle apparatus 100 is connected.

The gas header 3 has a hollow structure and, similarly to the distributer 1, has a connection pipe 3*a* to which a refrigerant pipe of the refrigeration cycle apparatus 100 is connected.

The communication header 2 has a hollow structure, and a heat transfer tube of each of the first heat transfer unit 51 and heat transfer tubes of the second heat transfer unit 52 is connected to the communication header 2.

The first heat transfer unit 51 has a plurality of first heat transfer tubes 51*a* connecting the distributer 1 and the communication header 2 to each other. Further, the first heat transfer unit 51 has a plurality of fins 51*b* positioned orthogonal to the axial direction of the first heat transfer tubes 51*a*.

The first heat transfer tubes 51*a* and the fins 51*b* are, for example, made of aluminum and are integrated with each other through a brazing process.

The second heat transfer unit 52 has a plurality of second heat transfer tubes 52*a* connecting the gas header 3 and the communication header 2 to each other. Further, the second heat transfer unit 52 has a plurality of fins 52*b* positioned orthogonal to the axial direction of the second heat transfer tubes 52*a*.

The second heat transfer tubes 52*a* and the fins 52*b* are, for example, made of aluminum and are integrated with each other through a brazing process.

As the first heat transfer tubes 51*a* and the second heat transfer tubes 52*a*, flat multiple-hole pipes may be used, for example.

The distributer 1 and the first heat transfer tubes 51*a* of the first heat transfer unit 51 are connected to each other via connection pipes 51*c* and joints 51*d*, as shown in FIG. 3. In other words, to the plurality of first heat transfer tubes 51*a*, the connection pipes 51*c* of the same number as that of the first heat transfer tubes 51*a* and the joints 51*d* of the same number as that of the first heat transfer tubes 51*a* are connected, to allow communication with the distributer 1.

Further, as shown in FIG. 4, the first heat transfer tubes 51*a* of the first heat transfer unit 51 and the second heat transfer tubes 52*a* of the second heat transfer unit 52 are connected to the communication header 2. In this situation, the ends of the first heat transfer tubes 51*a* and the second heat transfer tubes 52*a* are in the state of protruding to the inside of the communication header 2.

<A Flow of the Refrigerant in the Heat Exchanger 50>

Next, a configuration in which the heat exchanger 50 according to Embodiment 1 is applied to the outdoor heat exchanger 113 will be explained.

At first, two-phase gas-liquid refrigerant having been decompressed by the expansion valve 114 flows into the connection pipe 1*a* of the distributer 1. The refrigerant having flowed into the distributer 1 is branched by the branching flow path (explained later) and flows into the plurality of connection pipes 51*c*, The refrigerant having flowed into the connection pipes 51*c* flows into the first heat transfer tubes 51*a* of the first heat transfer unit 51 via the joints 51*d*. The two-phase gas-liquid refrigerant of which the quality has been enhanced as a result of a heat exchange with the air flows into the communication header 2. The refrigerant having turned around in the communication header 2 flows into the second heat transfer tubes 52*a* of the second heat transfer unit 52. The refrigerant having again exchanged heat with the air and been gasified flows into the gas header 3 and is sucked into the compressor 111 of the refrigeration cycle apparatus 100 through the connection pipe 3*a*.

Further, while the refrigeration cycle apparatus 100 is performing a cooling operation, the outdoor heat exchanger 113 acts as a condenser, so that the flow of the refrigerant in the heat exchanger 50 is in the direction reversed from the direction during the heating operation.

<A Configuration of the Distributer 1>

Figure 5:
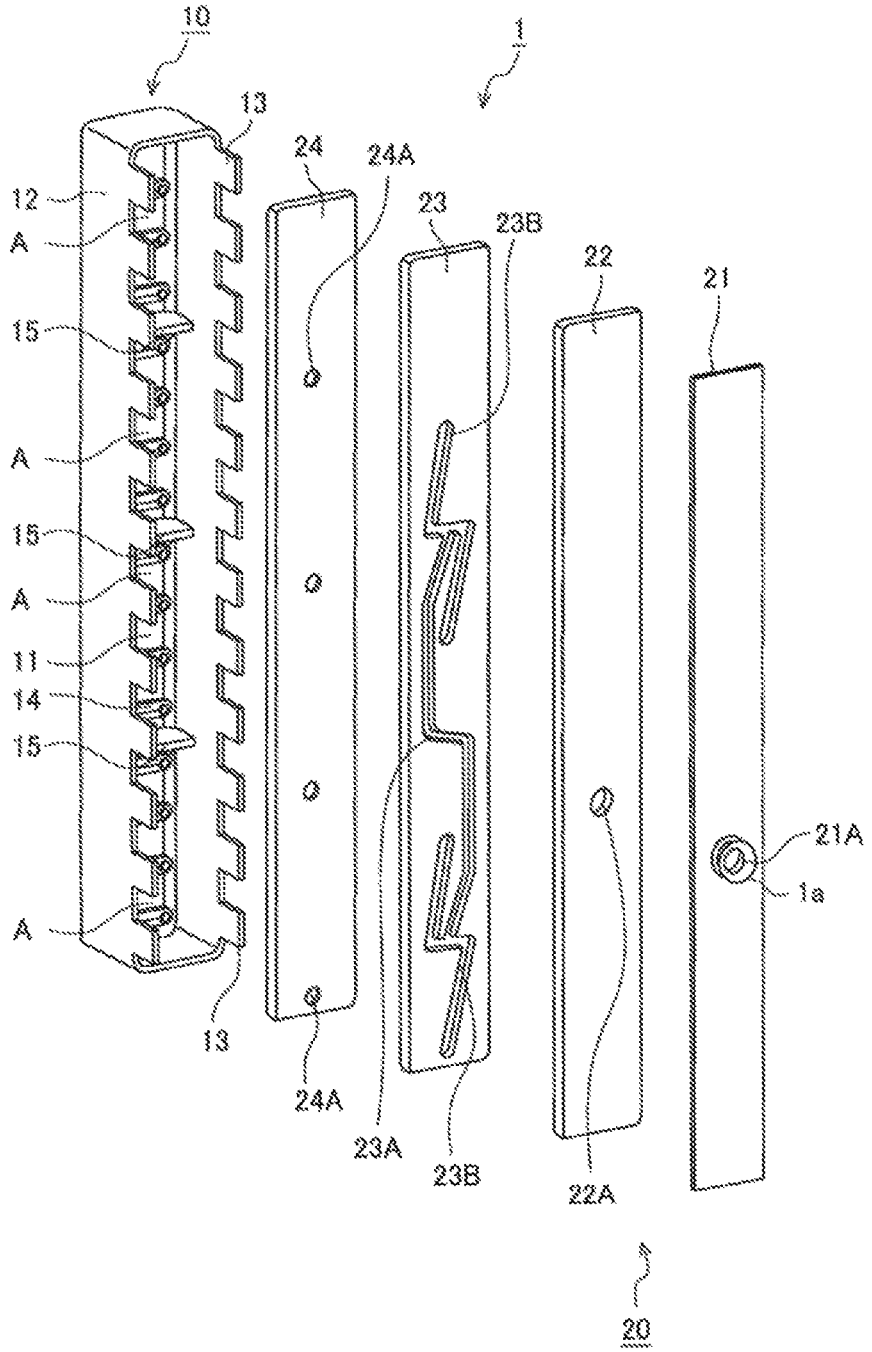
FIG. 5 is an exploded perspective view of the distributer 1 according to Embodiment 1.

FIG. 5 is an exploded perspective view of the distributer 1 according to Embodiment 1.

As shown in FIG. 5, the distributer 1 includes a housing 10. The housing 10 is made of aluminum, for example. The housing 10 may be, for example, a casing in the shape of a cuboid. The housing 10 has one of the faces that is open and is structured with a bottom face part 11 (corresponding to the surface portion of the present invention) facing the open face, four lateral face parts 12, and bendable parts 13 that are bendable. The housing 10 has an anti-corrosive treatment (e.g., anti-corrosive coating) applied to the surface of the housing 10.

The bottom face part 11 of the housing 10 has a plurality of through holes 14 extending through the bottom face part 11, in and to which the first heat transfer tubes 51*a* are inserted and fixed (by a brazing process). The through holes 14 are oblong openings aligned with the positional arrangements of the first heat transfer tubes 51*a* and are formed so that the lengthwise portions of the first heat transfer tubes 51*a* extend parallel to one another. The bendable parts 13 are provided on the open face of the housing 10 to protrude in the manner of comb teeth. The plurality of bendable parts 13 are formed at uniform intervals. Further, a plurality of partition plates 15 are provided to stand on the bottom face part 11. The partition plates 15 may be integrally formed with the housing 10 or may be structured as separate elements from the housing 10.

As shown in FIG. 5, the housing 10 houses a plurality of plates 20 stacked with each other. The plurality of plates 20 are each formed to have a substantially rectangular shape, while the exterior dimension of the flat faces of the plurality of plates 20 are the same as one another. For example, the plates 20 are made of aluminum. When the plates 20 are housed into the housing 10, the bendable parts 13 are bent toward the inside of the housing 10, so that the plurality of plates 20 are fixed to be caulked together on the inside of the housing 10 to closely adhere to one another. In that situation, the plates 20 are placed on the partition plates 15 standing on the bottom face part 11 of the housing 10, so that gap spaces A are defined between the bottom face part 11 and the plates 20. In this situation, the plates 20 may be integrated together in advance by a brazing process. Alternatively, the housing 10 and the plates 20 may be fixed to each other by a brazing process.

As being stacked with each other, the plurality of plates 20 form the branching flow path. In the plurality of plates 20, the branching flow path is formed as a result of forming a plurality of types of flow paths and boring opening holes through a pressing process. The branching flow path acts as a distributer for refrigerant, for example.

It is possible to modify the number of plates 20 to be used, depending on the number of times the branching flow path is branched and the length of the flow path.

<A Configuration of the Plates 20>

A configuration of the plates 20 according to Embodiment 1 will be explained below.

As shown in FIG. 5, for example, the plates 20 are structured with a first plate 21, a second plate 22, a third plate 23, and a fourth plate 24 (corresponding to the second plate of the present invention) having identical rectangular shapes in a planar view.

In the first to the fourth plates 21 to 24, the branching flow path, which is formed while the plates 21 to 24 are stacked with each other, is formed as a penetrating part. The branching flow path is structured by a first flow path 21A (corresponding to the first opening of the present invention) formed as a circular through hole extending through the first plate 21, a second flow path 22A formed as a circular through hole extending through the second plate 22, a first branching flow path 23A and second branching flow paths 23B each formed as an S-shaped or substantially Z-shaped penetrating groove extending through the third plate 23, and third flow paths 24A (corresponding to the second opening of the present invention) each formed as a circular through hole extending through the fourth plate 24.

To the first path 21A formed in the first plate 21, the connection pipe 1*a* is attached.

While the plurality of plates 20 are stacked with each other, the first flow path 21A communicates with the second flow path 22A formed in the second plate 22.

While the plurality of plates 20 are stacked with each other, the second flow path 22A communicates with a substantially central part of the first branching flow path 23A, which is the S-shaped or substantially Z-shaped penetrating groove formed in the third plate 23.

Each of the two end parts of the first branching flow path 23A formed in the third plate 23 each communicates with a substantially central part of a corresponding one of the second branching flow paths 23B, which each are the S-shaped or substantially Z-shaped penetrating groove, similarly to the first branching flow path 23A, formed in the third plate 23.

While the plurality of plates 20 are stacked with each other, the two end parts of each of the second branching flow paths 23B communicate with the third flow paths 24A formed in the fourth plate 24.

Further, the third flow paths 24A communicate with the gap spaces A defined between the fourth plate 24 and the bottom face part 11 of the housing 10.

The gap spaces A are separated by the partition plates 15, so that, for example, four gap spaces A are separated by the three partition plates 15 in the example shown in FIG. 5.

In this situation, only the housing 10 and an outer circumferential surface of the first plate 21 among the plates 20 may be fixed together by a brazing process. Further, the partition plates 15 may be formed on the fourth plate 24.

<A Configuration in the Surroundings of the Gap Spaces A of the Distributer 1>

Next, a configuration of the gap spaces A will be explained, with reference to FIGS. 6 and 7.

Figure 6:
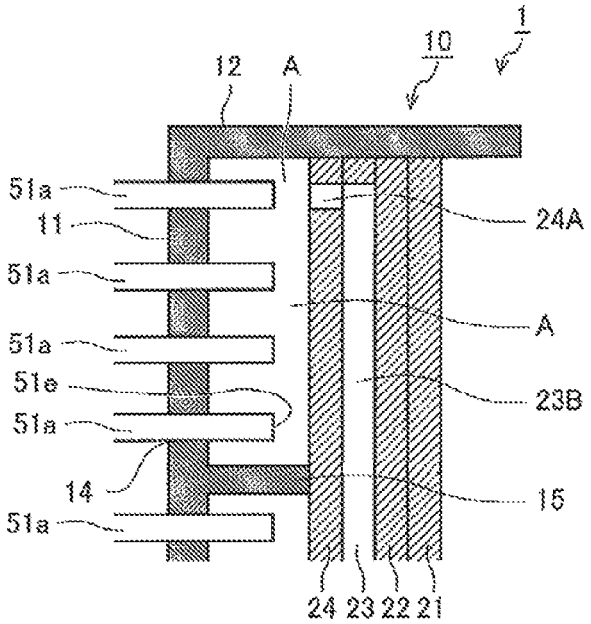
FIG. 6 is a cross-sectional view in a longitudinal direction of the distributer 1 according to Embodiment 1.

FIG. 6 is a cross-sectional view in a longitudinal direction of the distributer 1 according to Embodiment 1.

Figure 7:
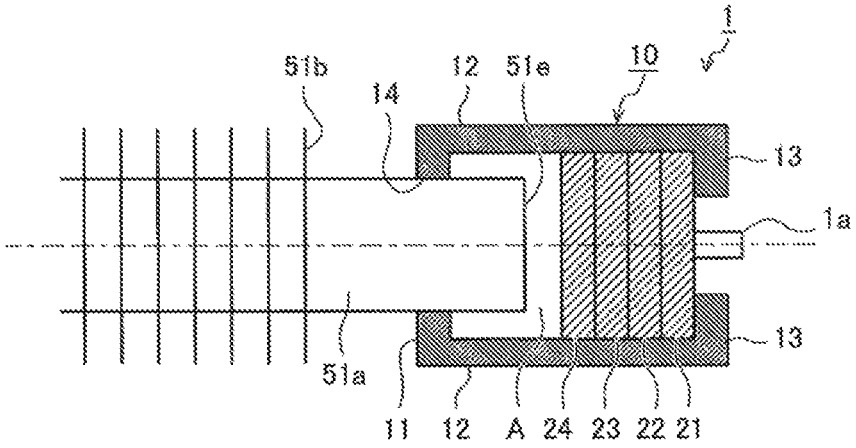
FIG. 7 is a cross-sectional view in a direction orthogonal to the longitudinal direction of the distributer 1 according to Embodiment 1.

FIG. 7 is a cross-sectional view in a direction orthogonal to the longitudinal direction of the distributer 1 according to Embodiment 1.

The distributer 1 illustrated in FIGS. 6 and 7 represents an example in which the first heat transfer tubes 51*a* are directly connected to the housing 10, while the connection pipes 51*c* and the joints 51*d* illustrated in FIG. 3 are omitted.

As shown in FIGS. 6 and 7, each of the third flow paths 24A formed in the fourth plate 24 communicates with a corresponding one of the gap spaces A defined between the fourth plate 24 and the bottom face part 11 of the housing 10. Further, in each of the gap spaces A, tip end parts 51*e* of the first heat transfer tubes 51*a* are disposed to extend through the through holes 14 opened in the bottom face part 11 of the housing 10. When the distributer 1 and the first heat transfer tubes 51*a* are connected to each other via the connection pipes 51*c* and the joints 51*d* as shown in FIG. 3, tip end parts of the connection pipes 51*c* are arranged in the gap spaces A.

<A Flow of the Refrigerant in the Branching Flow Path>

Next, a flow of the refrigerant in the branching flow path of the distributer 1 will be explained.

In the following sections, an example will be explained in which the heat exchanger 50 acts as an evaporator.

At first, the refrigerant forming a two-phase gas-liquid flow flows into the branching flow path through the first flow path 21A formed in the first plate 21. The refrigerant having flowed in flows straight through the first flow path 21A and the second flow path 22A, collides with the surface of the fourth plate 24 in the first branching flow path 23A formed in the third plate 23, and is divided into two directions in the S-shaped or substantially Z-shaped first branching flow path 23A. The refrigerant having reached the two ends of the first branching flow path 23A flows into the second branching flow paths 23B and is branched into two directions in the S-shaped or substantially Z-shaped second branching flow paths 23B. The refrigerant having reached the two ends of each of the second branching flow paths 23B flows into a corresponding one of the pairs of third flow paths 24A.

The refrigerant having flowed into the third flow paths 24A jets into the gap spaces A. The refrigerant having stayed in the gap spaces A is evenly distributed and flows into the first heat transfer tubes 51*a*.

In the present example, with the branching flow path according to Embodiment 1, the distributer 1 has branched four ways in such a manner that the refrigerant passes sequentially through two branching flow paths; however, the number of times of branching and the number of branches are not limited to those in this example.

<Assembly Steps of the Distributer 1>

Next, assembly steps of the distributer 1 will be explained.

At step 1, the plurality of plates 20 stacked with each other are housed inside the housing 10. In this situation, the plurality of plates 20 may have been integrated together in advance through a brazing process or other processes.

At step 2, the bendable parts 13 of the housing 10 are bent toward the inside of the housing 10 to fix the plurality of plates 20 on the inside of the housing 10.

Subsequently, at step 3, the tip end parts 51*e* of the first heat transfer tubes 51*a* of the heat exchanger 50 are inserted through the through holes 14 of the housing 10 and are temporarily assembled.

At step 4, the heat exchanger 50 and the distributer 1, which are temporarily assembled at step 3, are heated in a furnace, so that the housing 10 with the plurality of plates 20 and the housing 10 with the first heat transfer tubes 51*a* are brazed together in the furnace.

<Advantageous Effects>

In the distributer 1 according to Embodiment 1, the refrigerant is caused to flow into the first heat transfer tubes 51*a* of the heat exchanger 50 through the gap spaces A defined between the plurality of plates 20 having the branching flow path and the housing 10. Consequently, the refrigerant having been stored in the gap spaces A is homogenized and thus flows evenly to the first heat transfer tubes 51*a*. Consequently, it is possible to prevent the liquid refrigerant and the gas refrigerant from flowing into the heat transfer tubes in the form of drifts. It is therefore possible to bring out a maximum level of heat transfer performance of the heat exchanger 50.

Further, because the plurality of plates 20 are housed in the housing 10 having the surface that is anti-corrosive treated, it is possible to prevent the plates 20 from being corroded and to prevent leakage of the refrigerant from the branching flow path.

Embodiment 2

The distributer 1 according to Embodiment 1 is configured in such a manner that the third flow paths 24A formed in the fourth plate 24 extend into the gap spaces A. In Embodiment 2, the positional arrangements of the third flow paths 24A are different. Further, the protruding length of the first heat transfer tubes 51*a* is also different.

Thus, a configuration in the surroundings of the gap spaces A will be explained. Because the other configurations are the same as those of the distributer 1 according to Embodiment 1, those elements are referred to in the drawings by using the same reference signs, and the explanations of the configurations will be omitted.

<Another Configuration of the Distributer 1>

Figure 8:
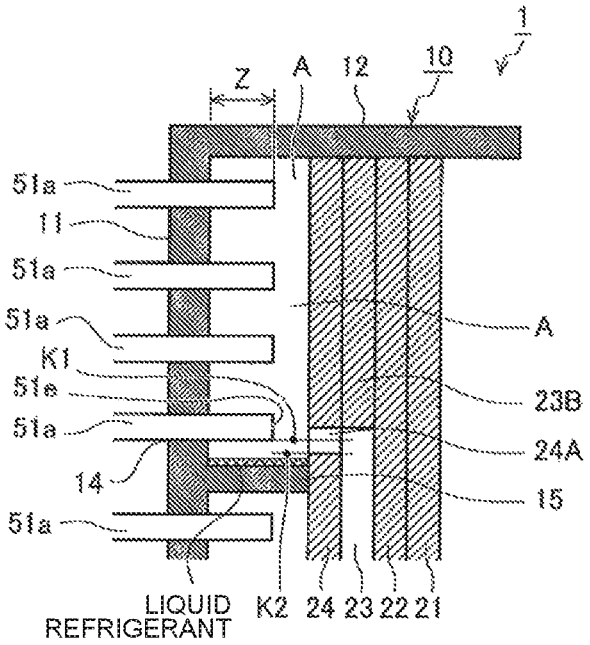
FIG. 8 is a cross-sectional view in a longitudinal direction of the distributer 1 according to Embodiment 2.

FIG. 8 is a cross-sectional view in a longitudinal direction of the distributer 1 according to Embodiment 2.

In the distributer 1 according to Embodiment 2, the position of each of the third flow paths 24A is defined on the basis of the lowermost first heat transfer tube 51*a* among the plurality of first heat transfer tubes 51*a* protruding to the inside of the gap space A as shown in FIG. 8. In other words, the lower end K2 of each of the third flow paths 24A is, in the horizontal direction, at the same position as, or is positioned lower than, that of the lower end K1 of the lowermost first heat transfer tube 51*a* among the plurality of first heat transfer tubes 51*a*.

Further, the protruding length Z of each of the first heat transfer tubes 51*a* in the gap space A is defined by the distance between the tip end part 51*e* of each of the first heat transfer tubes 51*a* and the inner surface of the bottom face part 11 of the housing 10. The protruding length Z according to Embodiment 2 is defined to be in the range from 3 mm to 10 mm inclusive.

<Advantageous Effects>

In the distributer 1 according to Embodiment 2, the lower end K2 of each of the third flow paths 24A is, in the horizontal direction, at the same position as, or is positioned lower than, that of the lower end K1 of the lowermost first heat transfer tube 51*a* among the plurality of first heat transfer tubes 51*a*. Consequently, it is possible to keep the amount of the liquid refrigerant stored in each of the gap spaces A at a minimum level. To be more specific, when the heat exchanger 50 acts as a condenser, in particular, the condensed liquid refrigerant stays in a lower part of each of the gap spaces A. Even in such a case, when each of the third flow paths 24A is positioned as described above, the liquid refrigerant is immediately discharged from each of the gap spaces A. It is possible to keep the amount of refrigerant needed in the refrigeration cycle apparatus 100 small, accordingly.

Further, because the protruding length Z of each of the first heat transfer tubes 51*a* into the gap spaces A is defined to be in the range from 3 mm to 10 mm inclusive, when the housing 10 and the first heat transfer tubes 51*a* are brazed together, it is possible to prevent the brazing material from flowing into the flow paths of the first heat transfer tubes 51*a*, Further, because the first heat transfer tubes 51*a* protrude to the inside of the gap spaces A, the capacity of each of the gap spaces A is reduced. It is possible to keep the amount of refrigerant needed in the refrigeration cycle apparatus 100 small, accordingly.

Embodiment 3

The distributer 1 according to Embodiment 1 is configured in such a manner that the third flow paths 24A formed in the fourth plate 24 extend into the gap spaces A. In Embodiment 3, the positional arrangements of the third flow paths 24A are different.

Thus, a configuration in the surroundings of the gap spaces A will be explained. Because the other configurations are the same as those of the distributer 1 according to Embodiment 1, those elements are referred to in the drawings by using the same reference signs, and the explanations of the configurations will be omitted.

<Yet Another Configuration of the Distributer 1>

Figure 9:
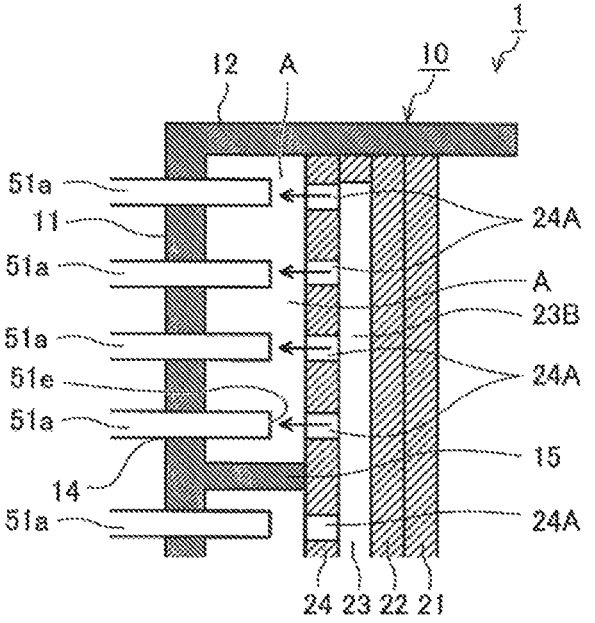
FIG. 9 is a cross-sectional view in a longitudinal direction of the distributer 1 according to Embodiment 3.

FIG. 9 is a cross-sectional view in a longitudinal direction of the distributer 1 according to Embodiment 3.

Figure 10:
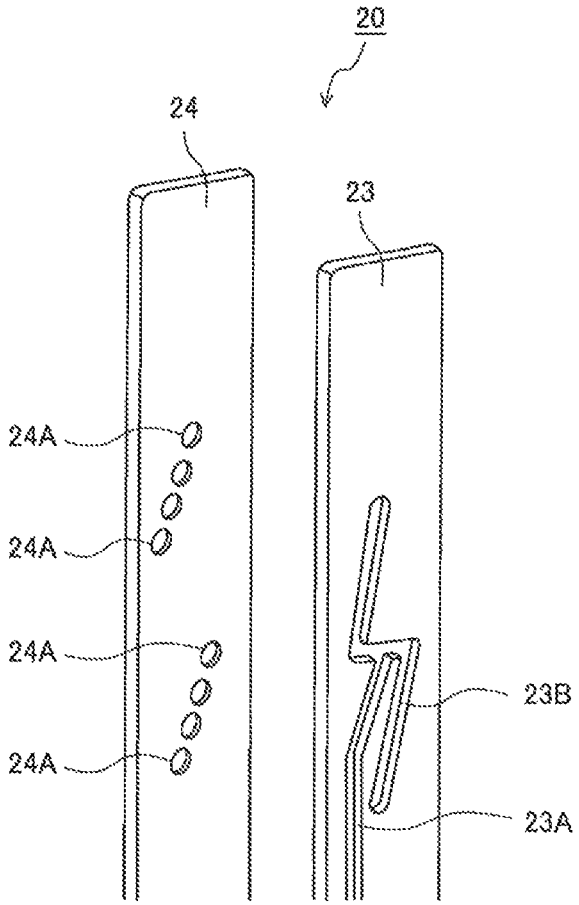
FIG. 10 is a perspective view of plates of the distributer 1 according to Embodiment 3.

FIG. 10 is a perspective view of the plates of the distributer 1 according to Embodiment 3.

In the distributer 1 according to Embodiment 3, a plurality of third flow paths 24A opening to a corresponding one of the gap spaces A are defined in multiple locations and face one plane of each of the second branching flow paths 23B, as illustrated in FIGS. 9 and 10. The plurality of third flow paths 24A are each provided to face a corresponding one of the plurality of first heat transfer tubes 51*a* or the through holes 14 opened in the housing 10. In other words, as illustrated in FIG. 9, the plurality of third flow paths 24A are provided in the same number as the number of the first heat transfer tubes 51*a* at the same heights (in the same positions in the longitudinal direction of the distributer 1) as the heights of the plurality of first heat transfer tubes 51*a* or the through holes 14. Further, as shown in FIG. 10, the plurality of third flow paths 24A are aligned in such positions that the plurality of third flow paths 24A communicate with the one plane of each of the second branching flow paths 23B formed in the third plate 23.

<Advantageous Effects>

In the distributer 1 according to Embodiment 3, the third flow paths 24A are provided in such positions that the third flow paths 24A each face a corresponding one of the plurality of first heat transfer tubes 51*a*. Consequently, the refrigerant flowing out of the third flow paths 24A are distributed to the first heat transfer tubes 51*a* facing the third flow paths 24A smoothly and evenly. Consequently, it is possible to prevent the refrigerant from flowing into the heat transfer tubes in the form of drifts. It is therefore possible to bring out a maximum level of heat transfer performance of the heat exchanger 50.

Embodiment 4

In the distributer 1 according to Embodiment 1, the first branching flow path 23A and the second branching flow paths 23B are formed in the single plate, namely, the third plate 23. In contrast, in Embodiment 4, the configurations of the first branching flow path 23A and the second branching flow paths 23B are different from those in Embodiment 1.

Because the other configurations are the same as those of the distributer 1 according to Embodiment 1, those elements are referred to in the drawings by using the same reference signs, and the explanations of the configurations will be omitted.

<Configuration of Plates 20>

Next, a configuration of plates 30 according to Embodiment 4 will be explained.

Figure 11:
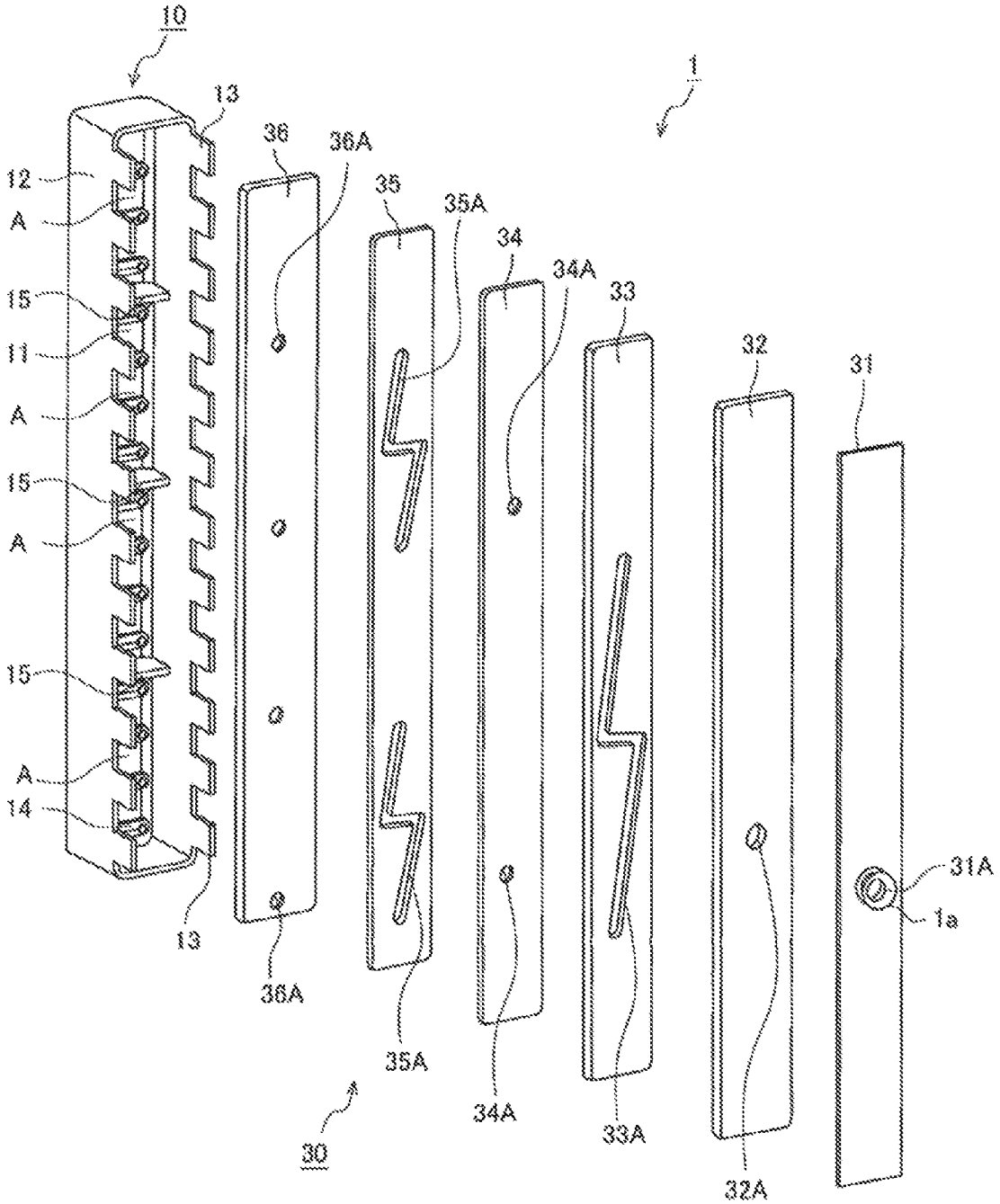
FIG. 11 is an exploded perspective view of the distributer 1 according to Embodiment 4.

FIG. 11 is an exploded perspective view of the distributer 1 according to Embodiment 4.

As illustrated in FIG. 11, for example, the plates 30 are structured with a first plate 31, a second plate 32, a third plate 33, a fourth plate 34, a fifth plate 35, and a sixth plate 36 (corresponding to the second plate of the present invention) having identical rectangular shapes in a planar view.

In the first to the sixth plates 31 to 36, the branching flow path, which is formed while the plates 31 to 36 are stacked with each other, is formed as a penetrating part. The branching flow path is structured by a first flow path 31A (corresponding to the first opening of the present invention) formed as a circular through hole extending through the first plate 31, a second flow path 32A formed as a circular through hole extending through the second plate 32, a first branching flow path 33A formed as an S-shaped or substantially Z-shaped penetrating groove extending through the third plate 33, two third flow paths 34A each formed as a circular through hole extending through the fourth plate 34, two second branching flow paths 35A each formed as an S-shaped or substantially Z-shaped penetrating groove extending through the fifth plate 35, and four fourth flow paths 36A (corresponding to the second opening of the present invention) each formed as a circular through hole extending through the sixth plate 36.

To the first flow path 31A formed in the first plate 31, the connection pipe 1*a* is attached.

While the plurality of plates 30 are stacked with each other, the first flow path 31A communicates with the second flow path 22A formed in the second plate 32.

While the plurality of plates 30 are stacked with each other, the second flow path 32A communicates with a substantially central part of the first branching flow path 33A, which is the S-shaped or substantially Z-shaped penetrating groove formed in the third plate 33.

While the plurality of plates 30 are stacked with each other, each of the two end parts of the first branching flow path 33A each communicates with a corresponding one of the third flow paths 34A formed in the fourth plate 34.

While the plurality of plates 30 are stacked with each other, each of the third flow paths 34A communicates with a substantially central part of a corresponding one of the second branching flow paths 35A, which each are the S-shaped or the substantially Z-shaped penetrating groove formed in the fifth plate 35.

While the plurality of plates 30 are stacked with each other, the two end parts of each of the second branching flow paths 35A communicate with the fourth flow paths 36A formed in the sixth plate 36.

Further, the fourth flow paths 36A communicate with the gap spaces A defined between the sixth plate 36 and the bottom face part 11 of the housing 10.

The gap spaces A are separated by the partition plates 15, so that, for example, four gap spaces A are separated by the three partition plates 15 in the example shown in FIG. 11.

<A Flow of the Refrigerant in the Branching Flow Path>

Next, a flow of the refrigerant in the branching flow path of the distributer 1 will be explained.

In the following sections, an example will be explained in which the heat exchanger 50 acts as an evaporator.

At first, the refrigerant forming a two-phase gas-liquid flow flows into the branching flow path through the first flow path 31A formed in the first plate 31. The refrigerant having flowed in flows straight through the first flow path 31A and the second flow path 32A, collides with the surface of the fourth plate 34 in the first branching flow path 33A formed in the third plate 33, and is divided into two directions in the S-shaped or substantially Z-shaped first branching flow path 33A. The refrigerant having reached the two ends of the first branching flow path 33A flows into the two third flow paths 34A formed in the fourth plate 34.

The refrigerant having flowed into the third flow paths 34A collides with the surface of the sixth plate 36 in each of the second branching flow paths 35A formed in the fifth plate 35 and is divided into two directions in a corresponding one of the S-shaped or substantially Z-shaped second branching flow paths 35A. The refrigerant having reached the two ends of each of the second branching flow paths 35A flows into each of the four fourth flow paths 36A formed in the sixth plate 36.

The refrigerant having flowed into the fourth flow paths 36A jets into the gap spaces A. The refrigerant having stayed in the gap spaces A is evenly distributed and flows into the first heat transfer tubes 51*a*.

In the present example, with the branching flow path according to Embodiment 4, the distributer 1 has branched four ways in such a manner that each flow of the refrigerant passes sequentially through two branching flow paths; however, the number of times of branching and the number of branches are not limited to those in this example. For example, it is acceptable to arrange the branching flow path to be branched sixteen ways so that the refrigerant is branched into flows each face a corresponding one of the first heat transfer tubes 51*a*.

<Advantageous Effects>

In addition to the advantageous effects of Embodiment 1, in the distributer 1 according Embodiment 4, because the first branching flow path 33A and the second branching flow paths 35A are formed in the mutually-different plates 30, the refrigerant is less easily affected by the gravity. It is possible to cause the refrigerant to be distributed more evenly, accordingly. Consequently, it is possible to prevent the refrigerant from flowing into the heat transfer tubes in the form of drifts. It is therefore possible to bring out a maximum level of heat transfer performance of the heat exchanger 50.

<Configurations of the Distributer 1 According to the Present Invention>

The distributer 1 according to Embodiments 1 to 4 is configured to include (1) the housing 10 having the bottom face part 11 and the through holes 14 extending through the bottom face part 11, the plurality of plates 20 or 30 stacked with each other in the housing 10, the plurality of plates 20 or 30 including the first plate 21 or 3 that is the outermost one of the plurality of plates 20 or 30 and has the first opening extending through the first plate 21 or 3, and the second plate that is the other outermost one of the plurality of plates 20 or 30 and has the plurality of second openings extending through the second plate, the branching flow path connecting the first opening and the plurality of second openings, the plurality of connection pipes 51*c* each extending through a corresponding one of the through holes 14 in the bottom face part 11 of the housing 10, and the partition plates 15 disposed between the bottom face part 11 and the second plate, and abutting on both the bottom face part 11 and the second plate.

(2) Further, in the distributer 1 described in (1), the partition plates 15 may be formed on the bottom face part 11.

(3) Further, in the distributer 1 described in (1), the partition plates 15 may be formed on the second plate.

In the distributer 1 configured as described above, the refrigerant stored in the gap spaces A separated by the partition plates 15 is evenly homogenized and then flows into the heat transfer tubes. Consequently, it is possible to prevent the liquid refrigerant and the gas refrigerant from flowing into the heat transfer tubes in the form of drifts. It is therefore possible to bring out a maximum level of heat transfer performance of the heat exchanger 50.

Further, because the plurality of plates 20 or 30 are housed in the housing 10, it is possible to prevent the plates 20 or 30 from being corroded. It is therefore possible to prevent leakage of the refrigerant from the branching flow path.

(4) Further, in the distributer 1 described in any of (1) to (3), the gap spaces A separated by the partition plates 15 are defined between the bottom face part 11 and the second plate. The lower end K2 of one of the second openings opened to one of the gap spaces A is, in the horizontal direction, at the same position as that of the lower end K1 of the lowermost connection pipe 51*c* among the plurality of connection pipes 51*c* disposed in one of the gap spaces A or is positioned lower than the lower end K1 of the lowermost connection pipe 51*c* among the plurality of connection pipes 51*c*.

In the distributer 1 configured as described above, it is possible to keep the amount of the liquid refrigerant stored in each of the gap spaces A at a minimum level. In other words, while the heat exchanger 50 is acting as a condenser in particular, the condensed liquid refrigerant stays in a lower part of each of the gap spaces A. By positioning each of the second openings (the third flow paths 24A) as described above, the liquid refrigerant is immediately discharged from the gap spaces A. It is possible to keep the amount of refrigerant needed in the refrigeration cycle apparatus 100 small, accordingly.

(5) Further, in the distributer 1 described in any of (1) to (3), the plurality of second openings may be each provided to a corresponding one of the plurality of connection pipes 51*c* and may be formed in such positions that each of the plurality of second openings and the corresponding one of the plurality of connection pipes 51*c* face each other.

(6) Further, in the distributer 1 described in (5), the gap spaces A separated by the partition plates 15 may be defined between the bottom face part 11 and the second plate, so that the plurality of second openings extend into each of the gap spaces A.

In the distributer 1 configured as described above, the second openings are provided in such positions that the second openings face the plurality of first heat transfer tubes 51*a*. Consequently, the refrigerant flowing out of the second openings is distributed to the connection pipes 51*c* (the first heat transfer tubes 51*a*) facing the second openings smoothly and evenly. Consequently, it is possible to prevent the refrigerant from flowing into the connection pipes 51*c* (the first heat transfer tubes 51*a*) in the form of drifts. It is therefore possible to bring out a maximum level of heat transfer performance of the heat exchanger 50.

(7) Further, in the distributer 1 described in any of (1) to (6), the distance between the inner surface of the bottom face part 11 and the tip end part of each of the plurality of connection pipes 51*c* extending through the through holes 14 is sized in the range from 3 mm to 10 mm inclusive.

In the distributer 1 configured as described above, when the housing 10 and the first heat transfer tubes 51*a* are brazed together, it is possible to prevent the brazing material from flowing into the flow paths of the first heat transfer tubes 51*a*. Further, because the first heat transfer tubes 51*a* protrude to the inside of the gap spaces A, the capacity of each of the gap spaces A is reduced. It is therefore possible to keep the amount of refrigerant needed in the refrigeration cycle apparatus 100 small.

(8) Further, in the distributer 1 described in any of (1) to (7), the plurality of connection pipes 51*c* may each be configured as a heat transfer tube.

(9) Further, in the distributer 1 described in (8), the heat transfer tubes may each be configured as a flat multiple-hole pipe.

In the distributer 1 configured as described above, by directly connecting the heat transfer tubes (the first heat transfer tubes 51*a*) to the housing 10, it is possible to structure the heat exchanger 50 to be compact.

(10) Further, in the distributer 1 described in any of (1) to (9), an anti-corrosive treatment may be applied to the outer surface of the housing 10.

With the distributer 1 configured as described above, because the plates 20 or 30 housed on the inside of the housing 10 are prevented from being corroded, it is possible to prevent leakage of the refrigerant.

(11) Further, in the distributer 1 described in any of (1) to (10), the plurality of plates 20 or 30 may be fixed to one another with a brazing material interposed between the plurality of plates 20 or 30.

(12) Further, in the distributer 1 described in any of (1) to (11), the housing 10 and the plate having the first opening may be fixed together with a brazing material interposed between the housing 10 and the plate.

With the distributer 1 configured as described above, it is possible to prevent leakage of the refrigerant with certainty.

(13) Further, a heat exchanger may include the first heat transfer unit 51 to which the distributer 1 described in any of (1) to (12) is connected and the second heat transfer unit 52 aligned with the first heat transfer unit 51 in a direction in which air passes, and the first heat transfer tube 51*a* of the first heat transfer unit 51 and the second heat transfer tube 52*a* of the second heat transfer unit 52 communicate with each other via the communication header 2 that is hollow.

By using the heat exchanger 50 configured as described above, it is possible to structure the heat exchanger 50 to be compact by directly connecting the heat transfer tubes to the communication header 2.

(14) Further, an air-conditioning apparatus may include the heat exchanger described in (13).

When the air-conditioning apparatus described above is used, because the heat transfer performance of the heat exchanger is enhanced, it is possible to provide an air-conditioning apparatus having an excellent performance coefficient.

REFERENCE SIGNS LIST

1 distributer 1*a* connection pipe 2 communication header 3 gas header 3*a* connection pipe 10 housing 11 bottom face part (corresponding to the surface portion of the present invention) 12 lateral face part

13 bendable part 14 through hole 15 partition plate 20 plate 21 first plate 21A first flow path (corresponding to the first opening of the present invention)

22 second plate 22A second flow path 23 third plate 23A first branching flow path 23B second branching flow path 24 fourth plate (corresponding to the second plate of the present invention) 24A third flow path (corresponding to the second opening of the present invention) 30 plate 31 first plate 31A first flow path (corresponding to the first opening of the present invention)

32 second plate 32A second flow path 33 third plate 33A first branching flow path 34 fourth plate 34A third flow path 35 fifth plate

35A second branching flow path 36 sixth plate (corresponding to the second plate of the present invention) 36A fourth flow path (corresponding to the second opening of the present invention) 50 heat exchanger 51 first heat transfer unit 51*a* first heat transfer tube 51*b* fin 51*c* connection pipe

51*d* joint 51*e* tip end part 52 second heat transfer unit 52*a* second heat transfer tube 52*b* fin 100 refrigeration cycle apparatus 101 liquid-side communication pipe 102 gas-side communication pipe 110 outdoor unit

111 compressor 112 four-way switching valve 112*a* first port 112*b* second port 112*c* third port 112*d* fourth port 113 outdoor heat exchanger

114 expansion valve 115 outdoor fan 120 indoor unit 121 indoor heat exchanger 122 indoor fan A gap space K1 lower end K2 lower end Z protruding length

The invention claimed is:

1. A distributer, comprising:

a housing having a surface portion and through holes extending through the surface portion;

a plurality of plates stacked with each other in the housing, the plurality of plates including a first plate that is an outermost one of the plurality of plates and has a first opening extending through the first plate, and a second plate that is an other outermost one of the plurality of plates and has a plurality of second openings extending through the second plate;

a branching flow path connecting the first opening and the plurality of second openings;

a plurality of connection pipes each extending through a corresponding one of the through holes in the surface portion of the housing; and a partition plate disposed between the surface portion and the second plate, and abutting on both the surface portion and the second plate.

2. The distributer of claim 1, wherein the partition plate is formed on the surface portion.

3. The distributer of claim 1, wherein the partition plate is formed on the second plate.

4. The distributer of claim 1, wherein gap spaces separated by the partition plate are defined between the surface portion and the second plate, and a lower end of one of the plurality of second openings opened to one of the gap spaces is, in a horizontal direction, at a same position as that of a lower end of a lowermost one of the plurality of connection pipes disposed in one of the gap spaces or is positioned lower than the lower end of the lowermost one of the plurality of connection pipes.

5. The distributer of claim 1, wherein the plurality of second openings are each provided to a corresponding one of the plurality of connection pipes and are formed in such positions that each of the plurality of second openings and the corresponding one of the plurality of connection pipes face each other.

6. The distributer of claim 5, wherein gap spaces separated by the partition plate are defined between the surface portion and the second plate, and the plurality of second openings extend into each of the gap spaces.

7. The distributer of claim 1, wherein a distance between an inner surface of the surface portion and a tip end part of each of the plurality of connection pipes extending through the through holes is sized in a range from 3 mm to 10 mm inclusive.

8. The distributer of claim 1, wherein the plurality of connection pipes are each configured as a heat transfer tube.

9. The distributer of claim 8, wherein the heat transfer tubes are each configured as a flat multiple-hole pipe.

10. The distributer of claim 1, wherein an anti-corrosive treatment is applied to an outer surface of the housing.

11. The distributer of claim 1, wherein the plurality of plates are fixed to one another with a brazing material interposed between the plurality of plates.

12. The distributer of claim 1, wherein the housing and the first plate are fixed together with a brazing material interposed between the housing and the first plate.

13. A heat exchanger, comprising:

a first heat transfer unit to which the distributer of claim 1 is connected; and a second heat transfer unit aligned with the first heat transfer unit in a direction in which air passes, wherein a first heat transfer tube of the first heat transfer unit and a second heat transfer tube of the second heat transfer unit communicate with each other via a communication header that is hollow.

14. An air-conditioning apparatus, comprising the heat exchanger of claim 13.

15. The distributer of claim 1, wherein the plurality of plates stacked with each other in the housing are placed on the partition plate and fixed to an inside of the housing by bendable parts provided to the housing and bent toward the inside of the housing.

16. The distributer of claim 1, wherein the plurality of second openings face one plane of the branching flow path and are aligned to communicate with the one plane of the branching flow path.

* * * * *